United States Patent [19]

Adams

[11] Patent Number: 4,679,363

[45] Date of Patent: Jul. 14, 1987

[54] TOWNSHIP, CITY AND REGIONAL LAND ARRANGEMENT

[76] Inventor: George W. Adams, 425 Muddy Branch Rd. #101, Gaithersburg, Md. 20877

[21] Appl. No.: 823,276

[22] Filed: Jan. 28, 1986

[51] Int. Cl.[4] ..... E04H 3/04

[52] U.S. Cl. ..... 52/169.3; 52/33

[58] Field of Search ..... 52/33, 169.2, 169.3

[56] References Cited

U.S. PATENT DOCUMENTS

| | | | |
|---|---|---|---|
| D. 231,777 | 6/1974 | Glasbrenner | D25/99 |
| D. 239,769 | 5/1976 | Magill et al. | D25/3 |
| 506,291 | 10/1893 | Wheeler | 52/33 |
| 3,417,526 | 12/1968 | Lawson | 52/169.1 |
| 3,427,645 | 2/1969 | Sproul | 52/169.1 |
| 3,732,649 | 5/1973 | Mehran | 52/234 |

FOREIGN PATENT DOCUMENTS

| | | | |
|---|---|---|---|
| 1202468 | 5/1976 | Fed. Rep. of Germany . | |
| 228867 | 12/1924 | United Kingdom | 52/169.3 |

OTHER PUBLICATIONS

Journal of Homebuilding, Aug. 1968, pp. 65 thru 72.

National Geographic Magazine, Feb. 1974, pp. 260–261, illustrates a community design.

*Primary Examiner*—James L. Ridgill, Jr.

*Attorney, Agent, or Firm*—Donald A. Kettlestrings

[57] ABSTRACT

A township, city and regional land arrangement for accommodating a predetermined number of residents. The township land arrangement is circular in configuration having a plurality of concentric circular roadways intersected by a plurality of radially extending roadways. The city land arrangement is comprised of a plurality of township land arrangements located in spaced apart relationship with each other and substantially equidistant from a central circular university complex. A regional land arrangement is comprised of a predetermined plurality of the city land arrangements connected together by regional highways, monorails and railway lines.

41 Claims, 7 Drawing Figures

TOWNSHIP, CITY AND REGIONAL LAND ARRANGEMENT

This invention relates to a township, city and regional land arrangement and more particularly to such an arrangement which provides for a predetermined number of persons to reside and work in a predetermined area for optimal living conditions.

Many modern large cities have been overpopulated and built to such densities that living conditions have suffered. Problems with crime, transportation, waste disposal and commuting distances between home and office or factory have resulted. The size of many modern cities also has been damaging to the environment.

It is, therefore, an object of the present invention to provide a township, city and regional land arrangement which provides for no more than ten thousand persons to reside within each township.

Another object is to provide such a land arrangement which improves the quality of life for its people.

Still another object is to provide such a land arrangement which provides for improved transportation.

A still further object is to provide such a land arrangement which preserves the environment and provides for large amounts of green space.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a township land arrangement, comprising a first plurality of concentric circular roadways and a common center area; a second plurality of roadways radially extending outwardly from the center area and intersecting the first plurality of roadways; and a first plurality of segment areas, each defined by adjacent ones of the radially extending roadways and innermost and outermost ones of the concentric roadways.

In accordance with the invention, a city land arrangement comprises a predetermined plurality of the township land arrangements and further including a central circular university complex; the predetermined plurality of township land arrangements located in spaced apart relationship with each other and substantially equidistant from the university complex; access highways and monorails connected between the university complex and each of the township land arrangements: railway lines connected between each of the railway depots; a circumferential highway surrounding the plurality of township land arrangements: and second connector roadways extending between the circumferential highway and the outermost one of the first plurality of concentric circular roadways in each of the township land arrangements.

A regional land arrangement comprises a predetermined plurality of the city land arrangements and further includes regional highways and monorails connecting together the circumferential highways and monorails of a predetermined plurality of the city land arrangements; regional railway lines connecting together the railway lines of the predetermined plurality of the city land arrangements; a regional airport: and airport highways and monorails connecting the airport to the regional highways and monorails.

The invention in its broader aspects is not limited to the specific details shown and described, and departures may be made from such details without departing from the principles of the invention and without sacrificing its chief advantages.

The accompanying drawings, which are incorporated in and constitute a part of this specification, illustrate examples of preferred embodiments of the invention and, together with the description, serve to explain the principles of the invention.

Figure 1:
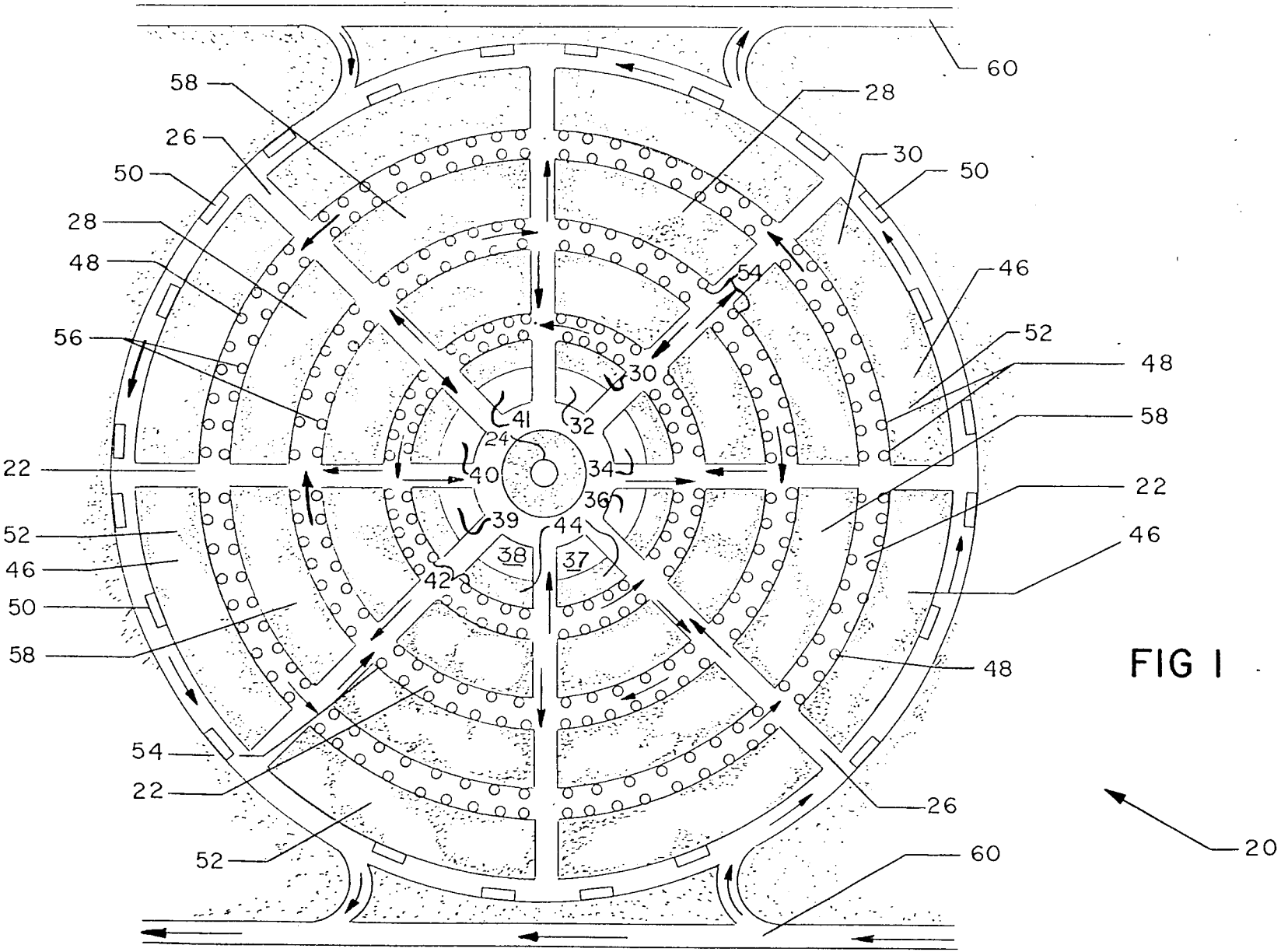
FIG. 1 is a plan view of one township embodiment.

With reference now to the drawings, wherein like reference characters designate like or corresponding parts throughout the several views, there is shown in FIG. 1 one preferred embodiment 20 of a township land arrangement in accordance with this invention. A first plurality of concentric circular roadways 22 are provided substantially equidistant from each other and centered about a common center area 24. A second plurality of roadways 26 radially extend outwardly from center area 24 and intersect each of roadways 22. A first plurality of segment areas 28, each defined by adjacent ones of radially extending roadways 26 and innermost and outermost ones of concentric roadways 22, are provided.

Each of segment areas 28 defines a plurality of substantially curved-shaped land areas 30, each land area being bounded by adjacent ones of concentric roadways 22 and by adjacent ones of radially extending roadways 26. Center area 24 is preferably substantially circular in shape, and in the preferred embodiment of FIG. 1 center area 24 includes a council house and a civic center.

As illustrated in FIG. 1, township land arrangement 20 preferably includes eight segment areas 28. An innermost one 32 of land areas 30 within a first one of segment areas 28 preferably includes an elementary school. Similarly an innermost one 34 of land areas 30 within a second one of segment areas 28 includes a library. Land area 36 includes a medical center, land area 37 includes a food center, land area 38 includes a shopping center, land area 39 includes an arts and craft center, land area 40 includes a job training center, and land area 41 includes a recreation center.

As illustrated in FIG. 1, each of innermost land areas 32–41 further includes housing units 42 and a first area 44 of green space and natural environment.

An outermost one 46 of land areas 30 within each of segment areas 28 includes a first plurality 48 of housing units, industrial facilities 50, and a second area 52 of green space and natural environment between housing units 48 and industrial facilities 50.

In accordance with the embodiment shown in FIG. 1, each of the remaining land areas 30 includes a second plurality of housing units 54, a third plurality of housing units 56, and a third area 58 of green space and natural environment between housing units 54 and 56.

Main access roadways 60 are connected to outermost concentric roadway 22 to provide for entry to and exit from township land arrangement 20.

Figure 2:
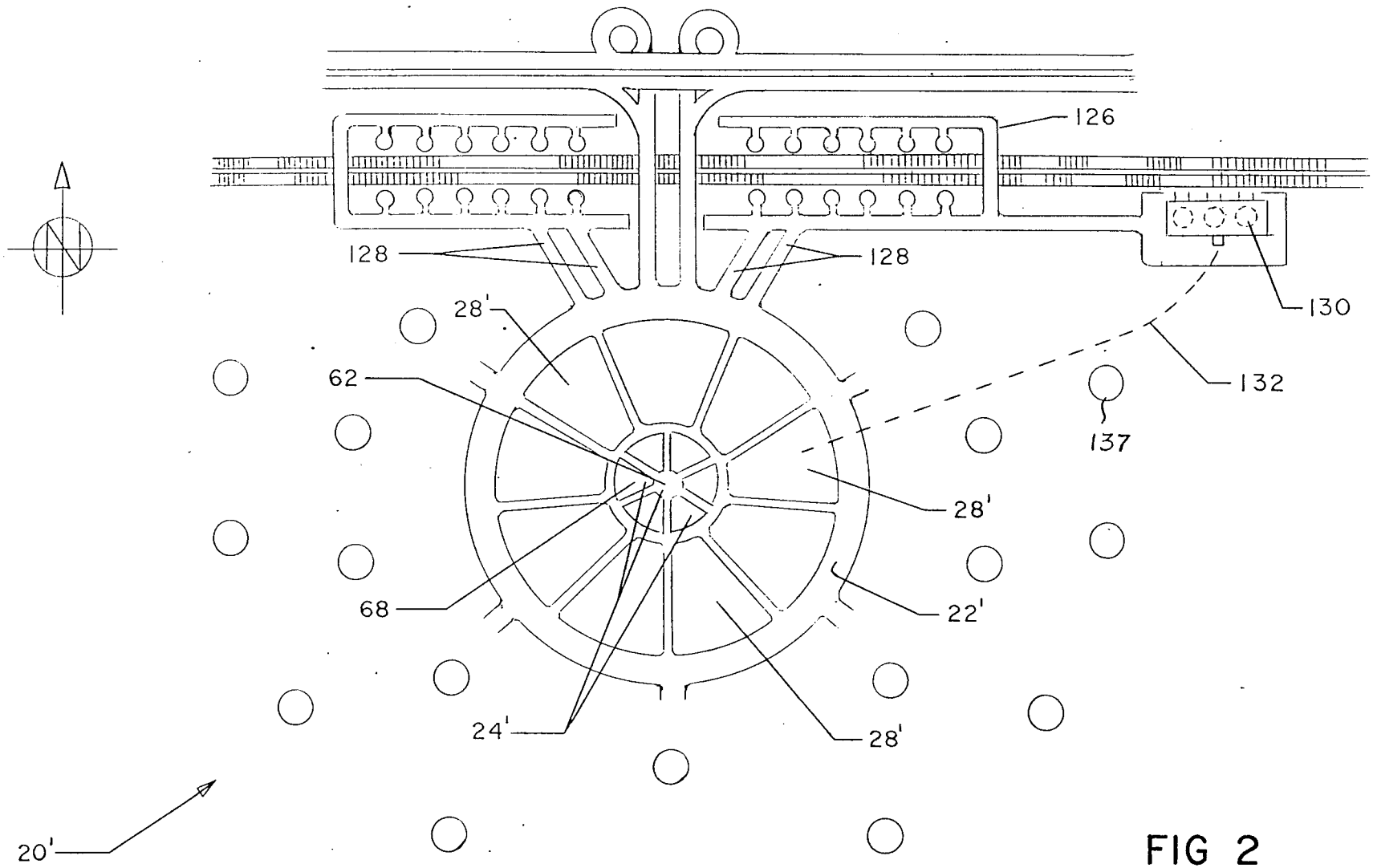
FIG. 2 is a fragmentary diagrammatic plan view of another township embodiment.
Figure 3:
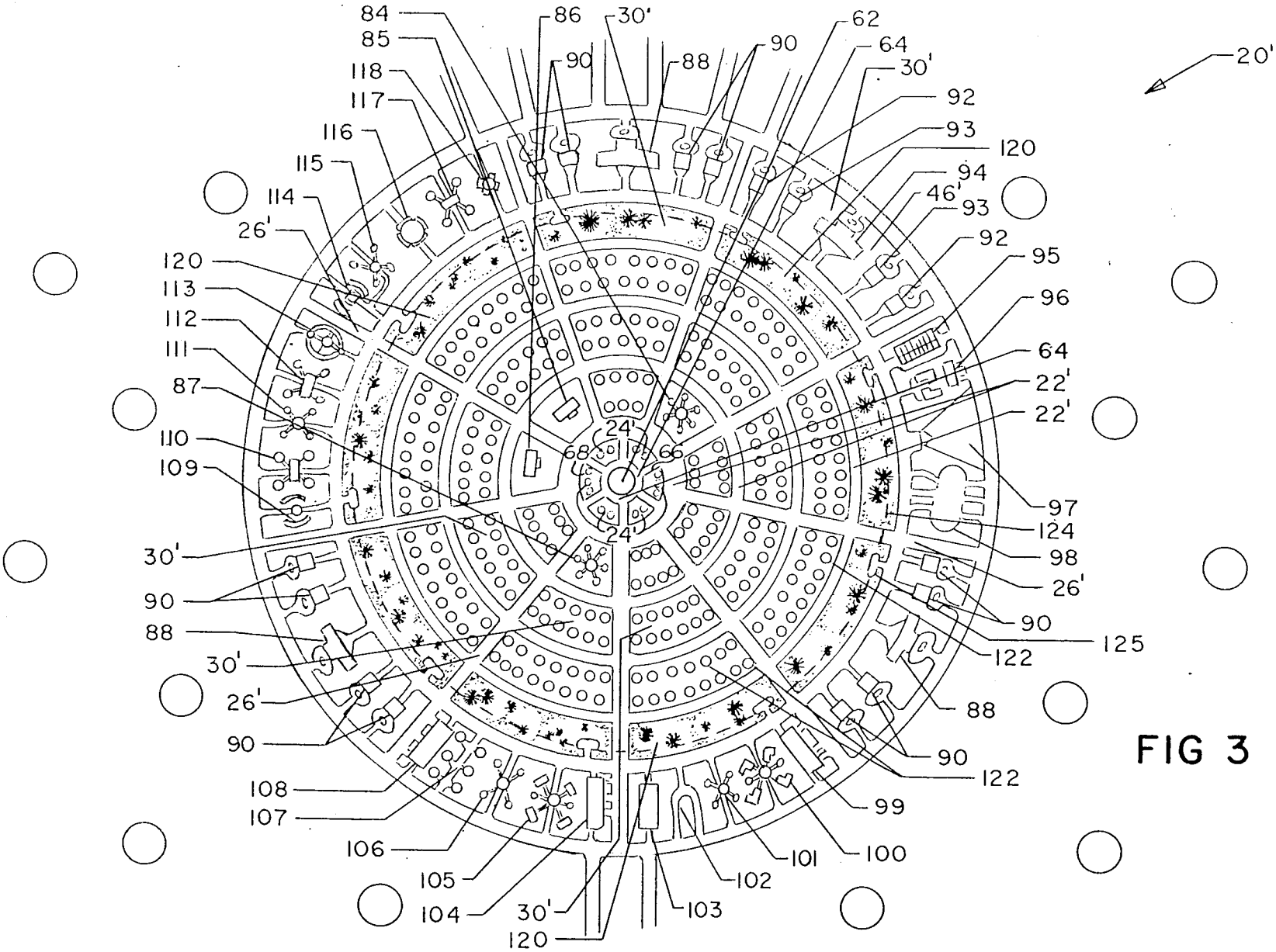
FIG. 3 is a detailed plan view of the township illustrated in FIG. 2.

Another township land arrangement 20′ is illustrated in FIGS. 2 and 3. Township land arrangement 20′ provides for nine segment areas 28′, and central area 24′ includes a house of worship 62 at the center of central area 24′. Central area 24′ also includes a first inner circular roadway 64 substantially surrounding house of worship 62, a third plurality of roadways 66 radially extending outwardly from inner circular roadway 64 and intersecting the innermost one of concentric circular roadways 22′. A second plurality of segment areas 68, each defined by adjacent ones of radially extending roadways 66, inner circular roadway 64 and the innermost one of concentric roadways 22′ are provided.

Figure 4:
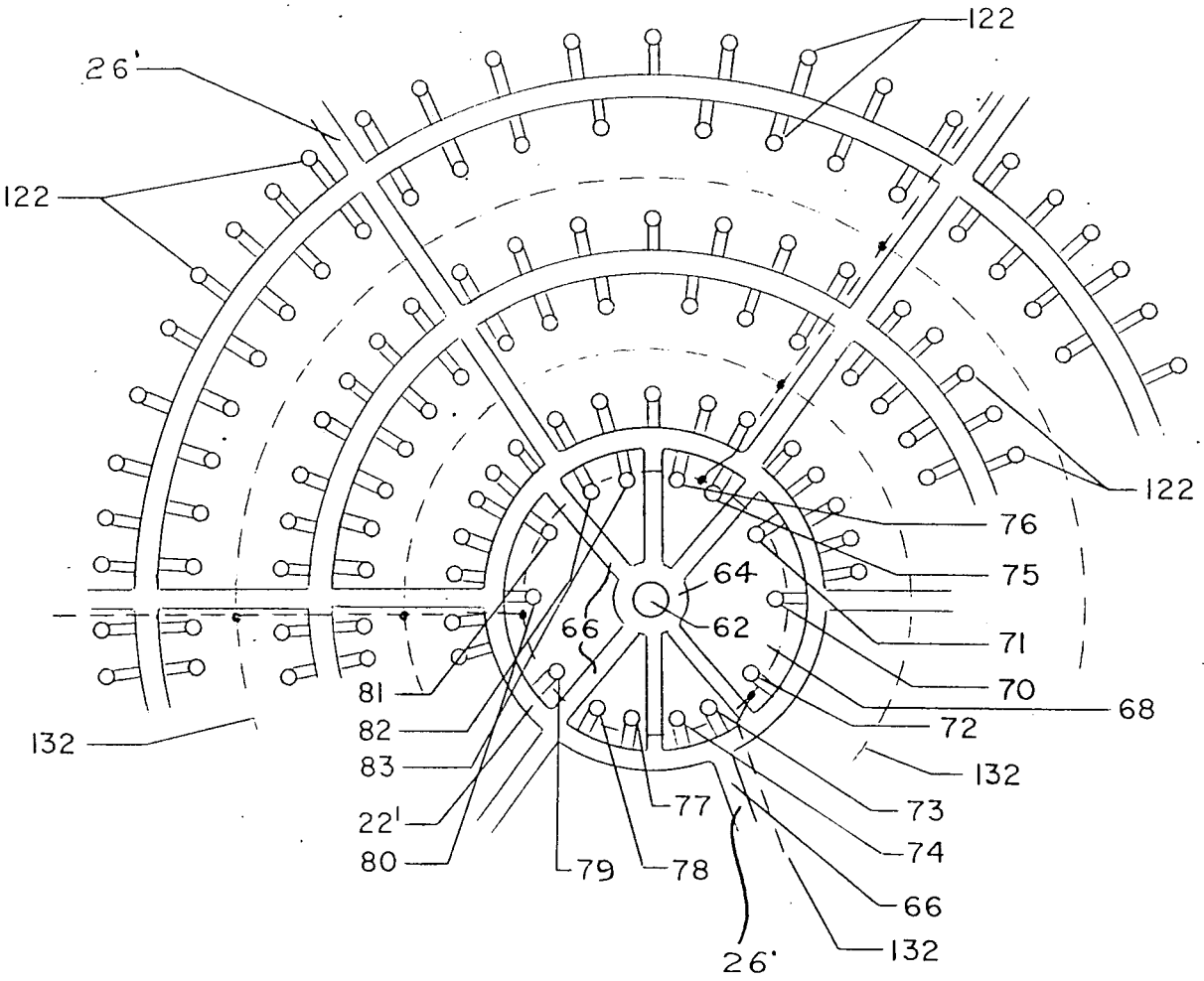
FIG. 4 is a fragmentary plan view showing in greater detail portions of the township illustrated in FIGS. 2 and 3.

FIG. 4 is an enlarged fragmentary view of a portion of township land arrangement 20′. In accordance with this embodiment of the invention, a first one of segment areas 68 includes a secretarial center 70, a treasury 71 and archives 72. A second one of segment areas 68 includes a library 73 and a publishing trust 74. A third one of segment areas 68 includes an assembly hall 75 and a council chamber 76. A fourth one of segment areas 68 includes a pilgrim hostel 77 and a college 78. A fifth one of segment areas 68 includes a school for the orphaned 79, a home for the blind 80 and a home for invalids 81. A sixth one of segment areas 68 includes a home for the elderly 82 and a hospice 83.

As illustrated in FIG. 3, township land arrangement 20′ includes a first elementary school 84 within an innermost one of land areas 30′ which is located within a first one of the first plurality of segment areas 28′. Similarly, a middle school 85 is located within an innermost one of land areas 30′ which is located within a second one of the first plurality of segment areas 28′. Likewise, a high school 86 and a second elementary school 87 are located within respective ones of innermost land areas 30′.

As illustrated in FIG. 3, township land arrangement 20′ includes an outermost one 46′ of land areas 30′ within each of segment areas 28′, and land areas 46′ include industrial, recreational and service facilities. For example, shopping malls 88, industrial facilities 90, municipal service facilities 92, fire station 93, police and ambulance station 94, tennis courts 95, basketball and volleyball courts 96, baseball fields 97, stadium 98, furniture repair center 99, household appliance service/-repair center 100, general services and sales center 101, gasoline station center 102, automotive sales and service center 103, public works department 104, water works department 105, police headquarters 106, telephone and electric center 107, fire station and ambulance center 108, general recovery center 109, dental center 110, administration center 111, specialized services center 112, emergency center 113, botanical gardens 114, arts and crafts center 115, performance theater 116, fine arts gallery 117, and cultural museum 118 may be located within outermost ones 46′ of land areas 30′.

Township land arrangement 20′, as illustrated in FIG. 3, also includes land areas 120 within each of segment areas 28′ and adjacent to outermost ones of areas 30′, and each of land areas 120 includes an area of green space and natural environment. Each of remaining land areas 30′ within segment areas 28′ includes a plurality of housing units 122.

Township land arrangement 20′ also includes a monorail 124 located within areas 120 of green space and natural environment, and monorail 124 is substantially concentric with common center area 24′. Monorail stations 125 are provided at spaced intervals along monorail 124.

As illustrated in FIG. 2, each township land arrangement 20′ includes a railway depot 126, and first connector roadways 128 extend between and connect depot 126 with the outermost one of concentric circular roadways 22′. Each township land arrangement 20′ also includes a central disposal center 130 located outside of the outermost one of concentric circular roadways 22′, and utility service tunnels 132, shown schematically in FIG. 2, are provided in communication between central disposal center 130 and predetermined portions of segment areas 28′ and 68.

Figure 5:
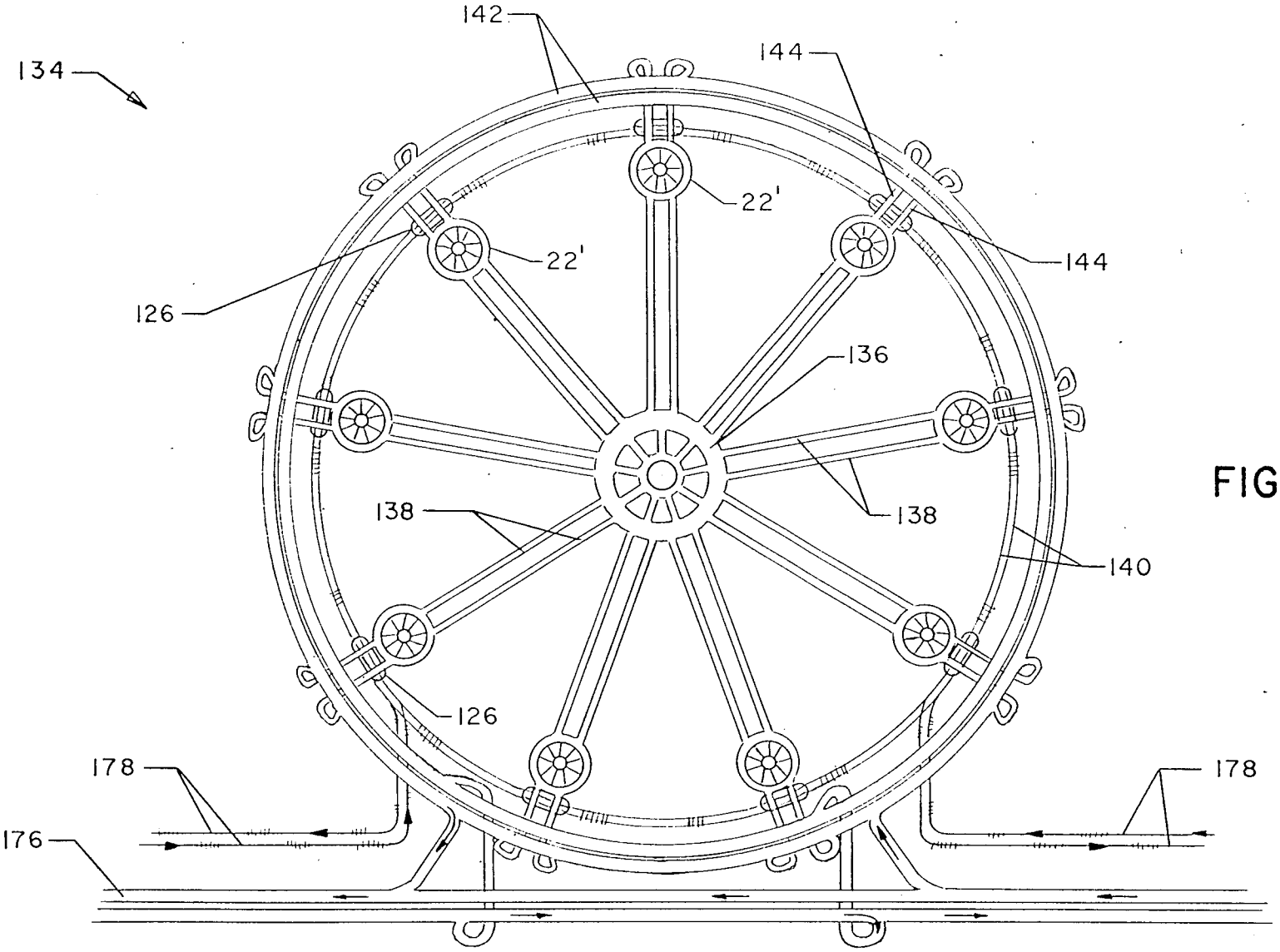
FIG. 5 is a plan view of a city.

A city land arrangement 134 in accordance with thisC invention is illustrated in FIG. 5. City land arrangement 134 comprises a predetermined plurality of township land arrangements 20′ and further includes a central circular university complex 136. A predetermined plurality (nine as illustrated in FIG. 5) of township land arrangements 20′ are located in spaced apart relationship with each other and substantially equidistant from university complex 136. Enclosed agricultural areas or domes 137 are located between each township 20′. Access highways 138 and monorails (not shown) are connected between university complex 136 and each of township land arrangements 20′. Railway lines 140 are connected between each of railway depots 126, and a circumferential highway 142 surrounds townships 20′. Second connector roadways 144 extend between and connect circumferential highway 142 and the outermost ones of concentric circular roadways 22′ in each of township land arrangements 20′.

Figure 6:
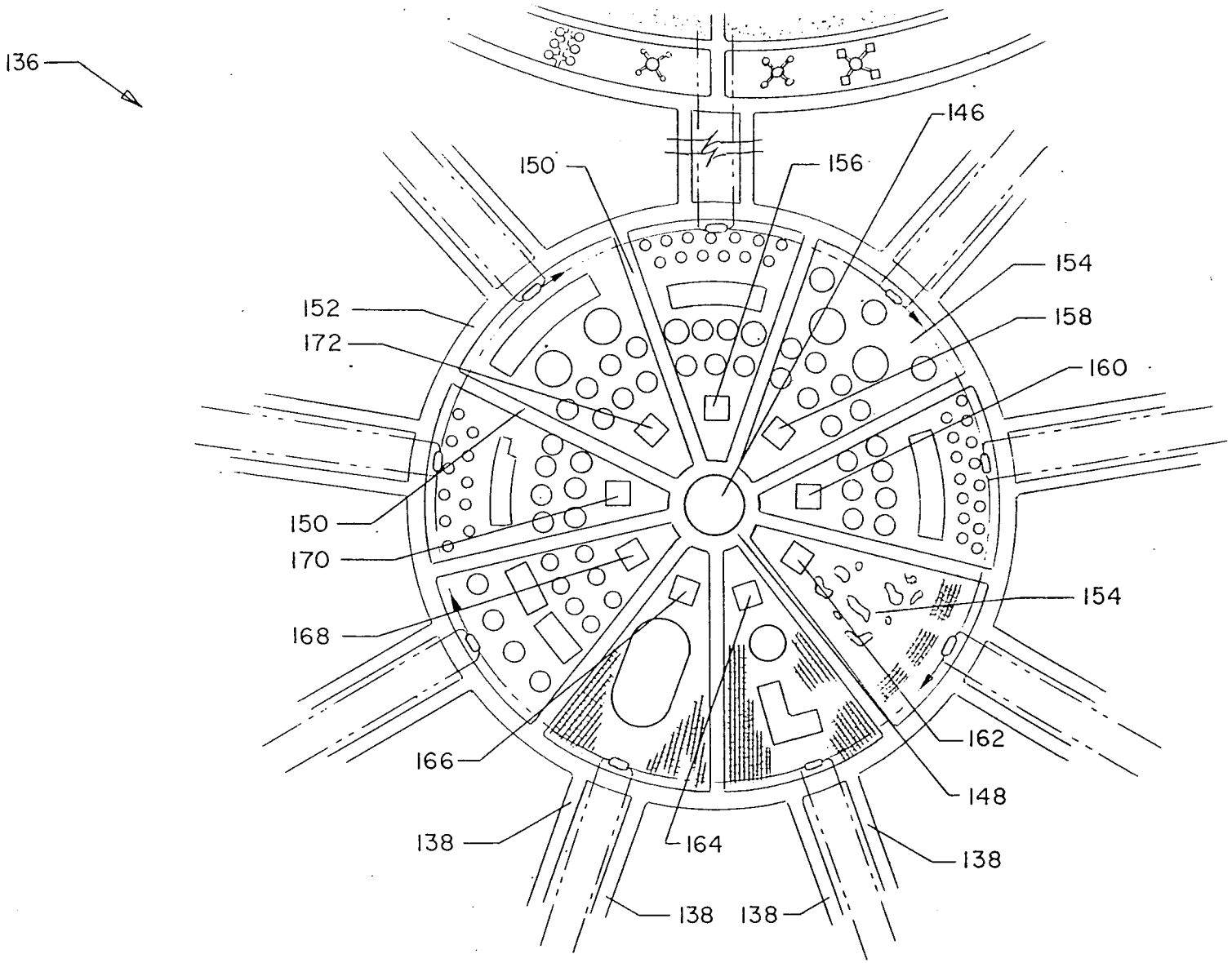
FIG. 6 is an enlarged plan view showing the central circular university complex in the city illustrated in FIG. 5.

As illustrated in FIG. 6, university complex 136 includes a central auditorium and theater 146, a second inner circular roadway 148 substantially surrounding central auditorium and theater 146, a fourth plurality of roadways 150 radially extending outwardly from inner circular roadway 148, a circumferential roadway 152 surrounding the university complex and intersecting roadways 150. A third plurality of segment areas 154 are each defined by adjacent ones of roadways 150, inner circular roadway 148 and circumferential roadway 152.

In accordance with a third embodiment of the invention as illustrated in FIG. 6, a first one of segment areas 154 includes a business-law complex and visitors center 156. Similarly, a second one of segment areas 154 includes a music and arts center 158, a third one of segment areas 154 includes an engineering center 160, a fourth one of segment areas 154 includes a golf course 162, a fifth one of segment areas 154 includes an indoor sports arena-swim center and general parking 164, a sixth one of segment areas 154 includes a stadium and general parking 166, a seventh one of segment areas 154 includes a science and medical center 168, an eighth one of segment areas 154 includes a history-politics-language center 170, and a ninth one of segment areas 154 includes an agricultural center 172.

Figure 7:
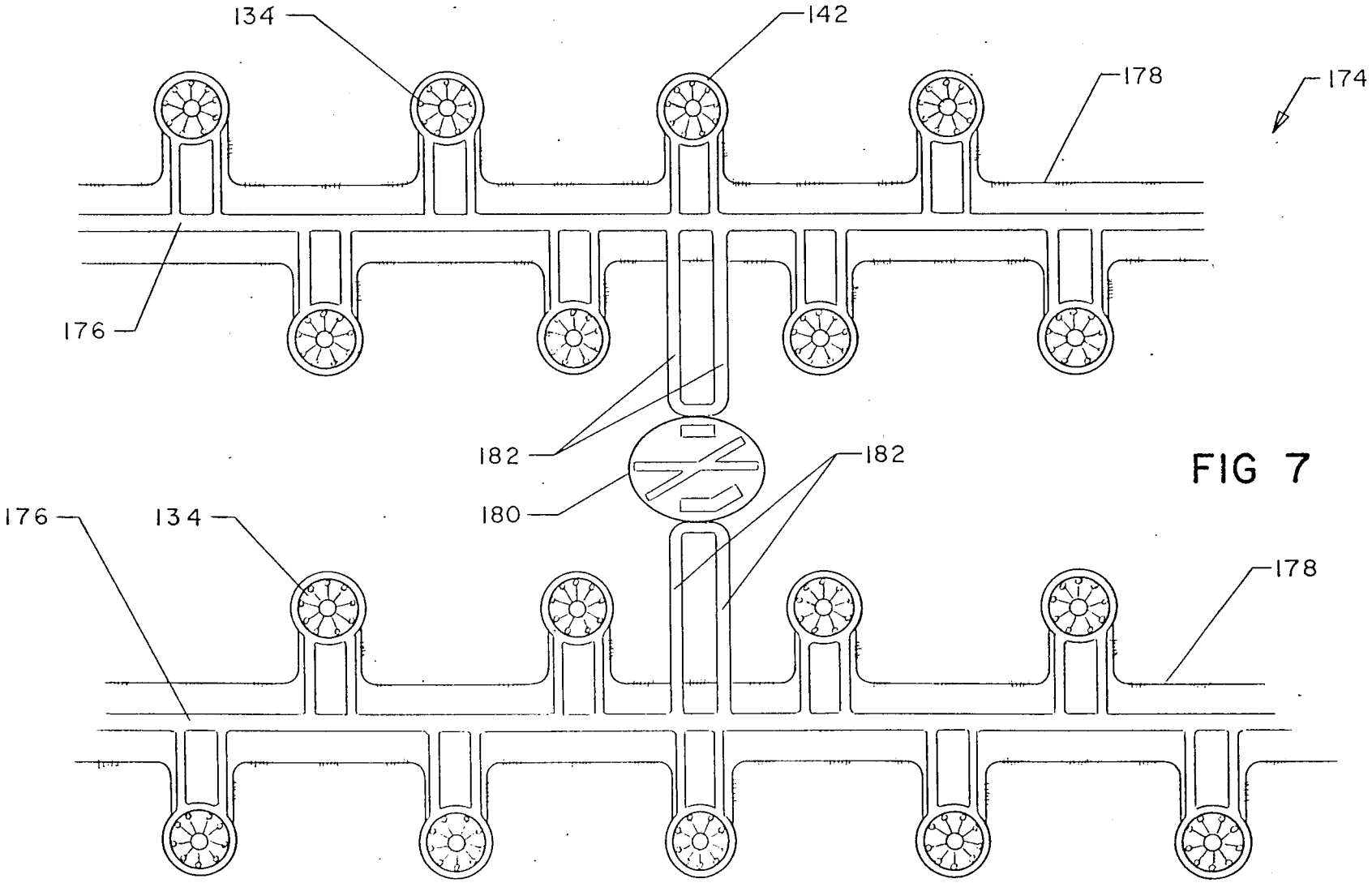
FIG. 7 is a plan view of a regional complex.

A regional land arrangement 174, in accordance with this invention, is illustrated in FIG. 7. Regional land arrangement 174 is comprised of a predetermined plurality of city land arrangements 134. Regional highways 176 and monorails (not shown) extend between and connect together circumferential highways 142 and monorails (not shown) of a predetermined plurality of city land arrangements 134. Regional railway lines 178 extend between and connect together railway lines 140 of city land arrangements 134. A regional airport 180 is provided and airport highways 182 and monorails (not shown) connect airport 180 to regional highways 176 and to regional monorails (not shown), respectively.

The invention in its broader aspects is not limited to the specific details shown and described, and departures may be made from such details without departing from the principles of the invention and without sacrificing its chief advantages.

What is claimed is:

1. A township land arrangement comprising:

a first plurality of concentric circular roadways, and a common center area defined at the center of said roadways;

a second plurality of roadways radially extending outwardly from said center area and intersecting said first plurality of roadways;

a first plurality of segment areas, each of said first plurality of segment areas defined by adjacent ones of said radially extending roadways and innermost and outermost ones of said concentric roadways;

each of said first plurality of segment areas defining a plurality of substantially curved-shaped adjacent land areas, each of said curved-shaped adjacent land areas bounded by adjacent ones of said concentric roadways and by adjacent ones of said radially extending roadways; and said center area being substantially circular in shape and including a council house and a civic center.

2. A township land arrangement as in claim 1 including eight of said segment areas.

3. A township land arrangement as in claim 2 wherein an innermost one of said land areas within a first one of said segment areas includes an elementary school.

4. A township land arrangement as in claim 3 wherein an innermost one of said land areas within a second one of said segment areas includes a library.

5. A township land arrangement as in claim 4 wherein an innermost one of said land areas within a third one of said segment areas includes a medical center.

6. A township land arrangement as in claim 5 wherein an innermost one of said land areas within a fourth one of said segment areas includes a food center.

7. A township land arrangement as in claim 6 wherein an innermost one of said land areas within a fifth one of said segment areas includes a shopping center.

8. A township land arrangement as in claim 7 wherein an innermost one of said land areas within a sixth one of said segment areas includes an arts and crafts center.

9. A township land arrangement as in claim 8 wherein an innermost one of said land areas within a seventh one of said segment areas includes a job training center.

10. A township land arrangement as in claim 9 wherein an innermost one of said land areas within an eighth one of said segment areas includes a recreation center.

11. A township land arrangement as in claim 10 wherein each of said innermost land areas further includes housing units and a first area of green space and natural environment.

12. A township land arrangement as in claim 11 wherein an outermost one of said land areas within each of said segment areas includes a first plurality of housing units, industrial facilities, and a second area of green space and natural environment between said first plurality of housing units and said industrial facilities.

13. A township land arrangement as in claim 12 wherein each of said remaining land areas includes a second plurality of housing units, a third plurality of housing units and a third area of green space and natural environment between said second and third plurality of housing units.

14. A township land arrangement, comprising:

a first plurality of concentric circular roadways, and a common center area defined at the center of said roadways;

a second plurality of roadways radially extending outwardly from said center area and intersecting said first plurality of roadways;

a first plurality of segment areas, each of said first plurality of segment areas defined by adjacent ones of said radially extending roadways and innermost and outermost ones of said concentric roadways;

each of said first plurality of segment areas defining a plurality of substantially curved-shaped adjacent land areas, each of said curved-shaped adjacent land areas bounded by adjacent ones of said concentric roadways and by adjacent ones of said radially extending roadways;

said center area being substantially circular in shape and said central area including: a house of worship at the center of said central area; a first inner circular roadway substantially surrounding said house of worship; a third plurality of roadways radially extending outwardly from said inner circular roadway and intersecting said innermost one of said first plurality of concentric circular roadways; a second plurality of segment areas, each defined by adjacent ones of said third plurality of radially extending roadways, said first inner circular roadway, and said innermost one of said first plurality of concentric circular roadways; and wherein a first one of said second plurality of segment areas includes a secretarial center, a treasury and archives.

15. A township land arrangement as in claim 14 wherein a second one of said second plurality of segment areas includes a library and a publishing trust.

16. A township land arrangement as in claim 15 wherein a third one of said second plurality of segment areas includes an assembly hall and a council chamber.

17. A township land arrangement as in claim 16 wherein a fourth one of said second plurality of segment areas includes a pilgrim hostel and a college.

18. A township land arrangement as in claim 17 wherein a fifth one of said second plurality of segment areas includes a school for the orphaned, a home for the blind and a home for invalids.

19. A township land arrangement as in claim 18 wherein a sixth one of said second plurality of segment areas includes a home for the elderly and a hospice.

20. A township land arrangement as in claim 14 wherein an innermost one of said land areas within a first one of said first plurality of segment areas includes a first elementary school.

21. A township land arrangement as in claim 20 wherein an innermost one of said land areas within a second one of said first plurality of segment areas includes a middle school.

22. A township land arrangement as in claim 21 wherein an innermost one of said land areas within a third one of said first plurality of segment areas includes a high school.

23. A township land arrangement as in claim 22 wherein an innermost one of said land areas within a fourth one of said first plurality of segment areas includes a second elementary school.

24. A township land arrangement as in claim 23 wherein an outermost one of said land areas within each of said first plurality of segment areas includes industrial, recreational and service facilities.

25. A township land arrangement as in claim 24 wherein one of said land areas within each of said first plurality of segment areas adjacent to said outermost one of said land areas within each of said first plurality of segment areas includes an area of green space and natural environment.

26. A township land arrangement as in claim 25 wherein each of said remaining land areas within said first plurality of segment areas includes a plurality of housing units.

27. A township land arrangement as in claim 26 further including a monorail located within said areas of green space and natural environment and said monorail being substantially concentric with said common center area.

28. A township land arrangement as in claim 27 further including a railway depot and first connector roadways extending between said depot and said outermost one of said first plurality of concentric circular roadways.

29. A township land arrangement as in claim 28 further including a central disposal center located outside of said outermost one of said first plurality of concentric circular roadways, and utility service tunnels in communication between said central disposal center and predetermined portions of said first and second segment areas.

30. A city land arrangement comprising a predetermined plurality of said township land arrangements as in claim 29 and further including:

a central circular university complex;

said predetermined plurality of said township land arrangements located in spaced apart relationship with each other and substantially equidistant from said university complex;

access highways and monorails connected between said university complex and each of said township land arrangements;

railway lines connected between each of said railway depots;

a circumferential highway surrounding said plurality of township land arrangements; and second connector roadways extending between said circumferential highway and said outermost one of said first plurality of concentric circular roadways in each of said township land arrangements.

31. A city land arrangement as in claim 30 wherein said central circular university complex includes:

a central auditorium and theater;

a second inner circular roadway substantially surrounding said central auditorium and theater;

a fourth plurality of roadways radially extending outwardly from said second inner circular roadway;

a circumferential roadway surrounding said university complex and intersecting said fourth plurality of roadways;

a third plurality of segment areas each defined by adjacent ones of said fourth plurality of radially extending roadways, said second inner circular roadway, and said circumferential roadway.

32. A city land arrangement as in claim 31 wherein a first one of said third plurality of segment areas includes a business-law complex and visitor's center.

33. A city land arrangement as in claim 32 wherein a second one of said third plurality of segment areas includes a music and arts center.

34. A city land arrangement as in claim 33 wherein a third one of said third plurality of segment areas includes an engineering center.

35. A city land arrangement as in claim 34 wherein a fourth one of said third plurality of segment areas includes a golf course.

36. A city land arrangement as in claim 35 wherein a fifth one of said third plurality of segment areas includes an indoor sports arena, swim center and general parking.

37. A city land arrangement as in claim 36 wherein a sixth one of said third plurality of segment areas includes a stadium and general parking.

38. A city land arrangement as in claim 37 wherein a seventh one of said third plurality of segment areas includes a science and medical center.

39. A city land arrangement as in claim 38 wherein an eighth one of said third plurality of segment areas includes a history, politics and language center.

40. A city land arrangement as in claim 39 wherein a ninth one of said third plurality of segment areas includes an agricultural center.

41. A regional land arrangement comprising a predetermined plurality of said city land arrangements as in claim 40 and further including:

regional highways and monorails connecting together said circumferential highways and monorails of a predetermined plurality of said city land arrangements;

regional railway lines connecting together said railway lines of said predetermined plurality of said city land arrangements;

a regional airport; and airport highways and monorails connecting said airport to said regional highways and monorails.

* * * * *